US006419222B1

(12) United States Patent
Morrison et al.

(10) Patent No.: US 6,419,222 B1
(45) Date of Patent: Jul. 16, 2002

(54) SHEET INVERTING APPARATUS AND METHOD

(75) Inventors: Elden R. Morrison; Brian R. Conrow, both of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/735,320

(22) Filed: Dec. 12, 2000

(51) Int. Cl.[7] ..... B65H 29/00
(52) U.S. Cl. ..... 271/186; 271/902; 271/265.01
(58) Field of Search ..... 271/184, 186, 271/176, 265.01, 225, 902, 65

(56) References Cited

U.S. PATENT DOCUMENTS

| | | | | |
|---|---|---|---|---|
| 3,416,791 A | | 12/1968 | Beckman, Jr. et al. | 271/65 |
| 3,588,472 A | | 6/1971 | Glaster et al. | 235/92 |
| 3,940,210 A | | 2/1976 | Donahue | 355/14 |
| 3,944,212 A | | 3/1976 | Stange et al. | 271/9 |
| 4,078,789 A | | 3/1978 | Kittredge et al. | 271/65 |
| 4,278,344 A | | 7/1981 | Sahay | 355/14 |
| 4,346,880 A | | 8/1982 | Roller et al. | 271/186 |
| 4,359,217 A | | 11/1982 | Roller et al. | 271/186 |
| 4,391,504 A | | 7/1983 | Acquaviva | 355/3 |
| 4,487,506 A | | 12/1984 | Repp et al. | 355/14 |
| 4,625,956 A | * | 12/1986 | Marass et al. | 271/176 |
| 5,106,075 A | * | 4/1992 | Wafford et al. | 271/186 |
| 5,261,657 A | * | 11/1993 | Edin | 271/184 |
| 5,449,164 A | * | 9/1995 | Quesnel et al. | 271/186 |
| 5,570,877 A | * | 11/1996 | Asami et al. | 271/186 |
| 5,926,681 A | * | 7/1999 | Ishimaru | 271/186 |

FOREIGN PATENT DOCUMENTS

| | | | | |
|---|---|---|---|---|
| JP | 403200661 A | * | 9/1991 | 271/186 |
| JP | 404246055 A | * | 9/1992 | 271/186 |

* cited by examiner

*Primary Examiner*—H. Grant Skaggs
(74) *Attorney, Agent, or Firm*—Bruce P. Watson

(57) ABSTRACT

A method and apparatus for inverting sheets traveling through a machine with an inverter having a reversing chute and a reversing nip in the reversing chute. An incoming sheet is receiving into the reversing chute. The reversing nip reverses the direction of travel of the sheet and drives sheet out of the reversing chute. A gap is opened in said reversing nip, while the outgoing sheet still extends through the reversing nip. A subsequent incoming sheet is received into the reversing chute and through the gap in the reversing nip, while the outgoing sheet still extends through the gap. The gap is closed after the outgoing sheet has exited the reversing nip, such the reversing nip reverses the direction of travel of the subsequent incoming sheet and drives the sheet out of the reversing chute. The machine may be a printing or copying machine.

21 Claims, 6 Drawing Sheets

FIG. 4
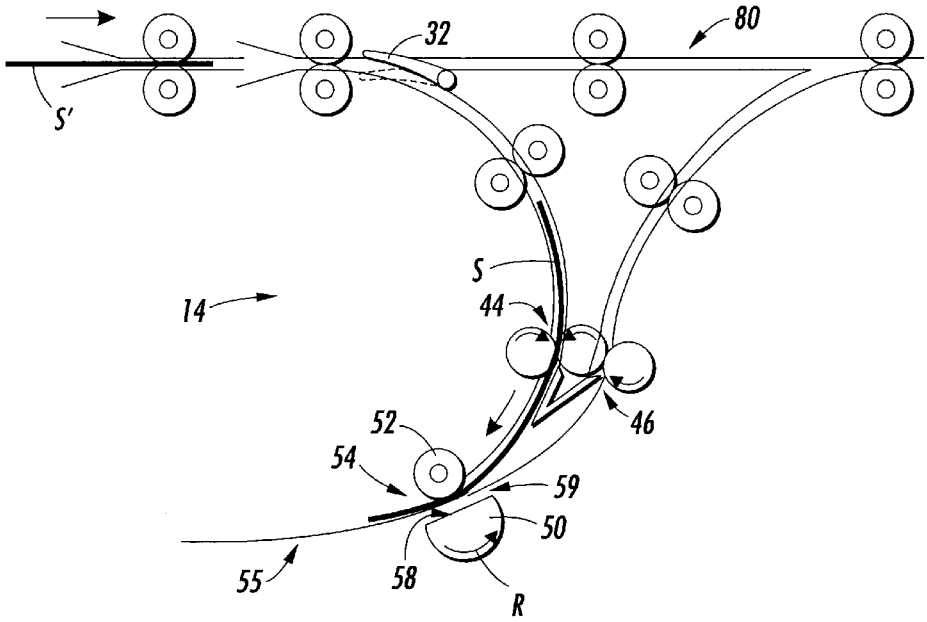
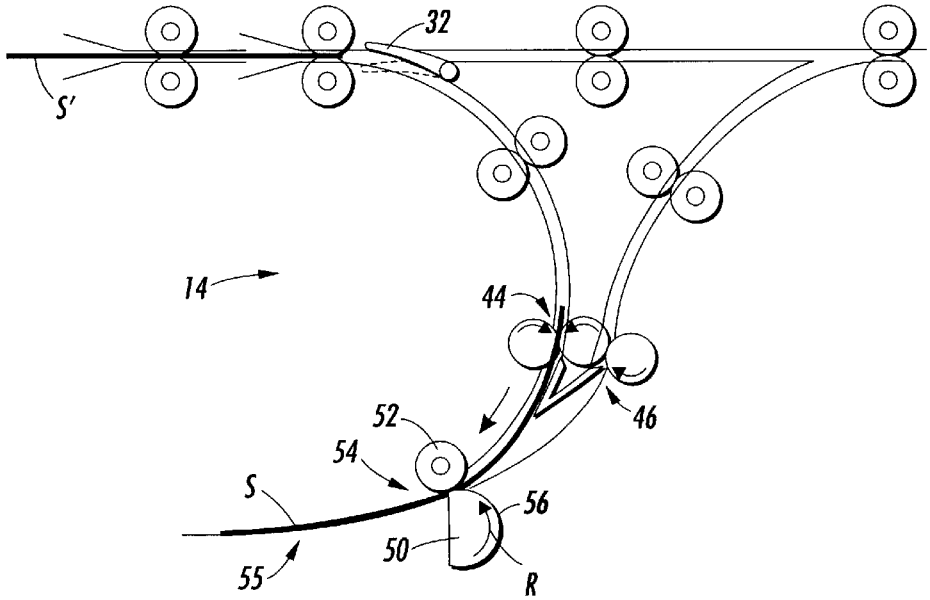
FIG. 5

FIG. 6
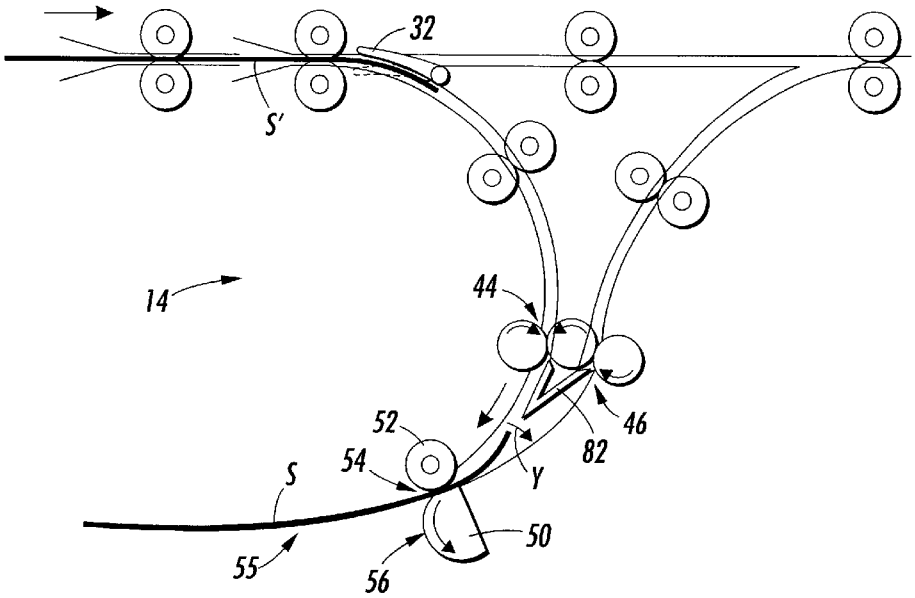
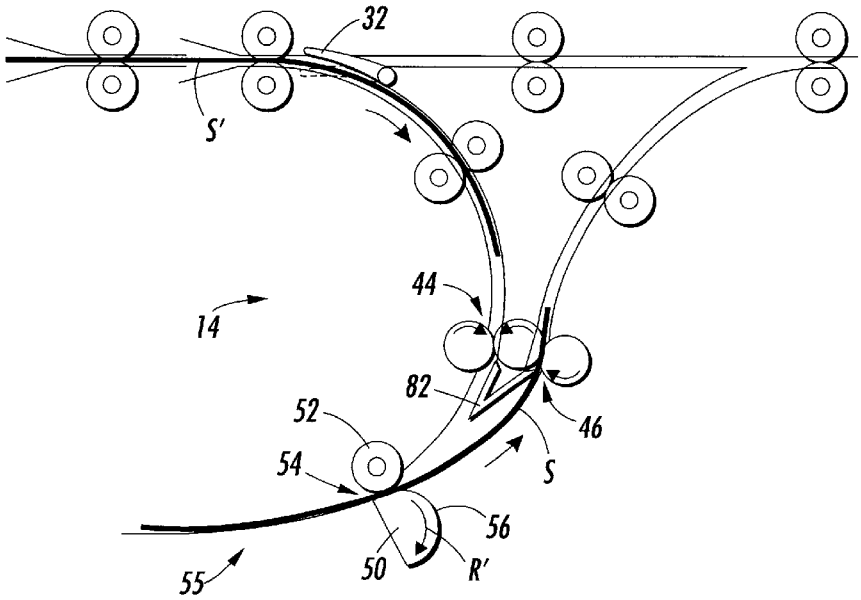
FIG. 7

FIG. 8
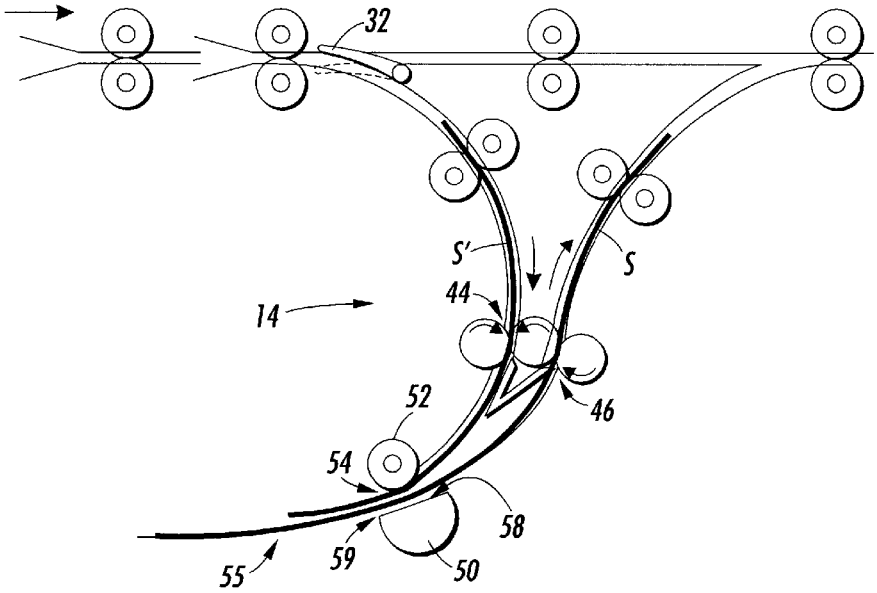
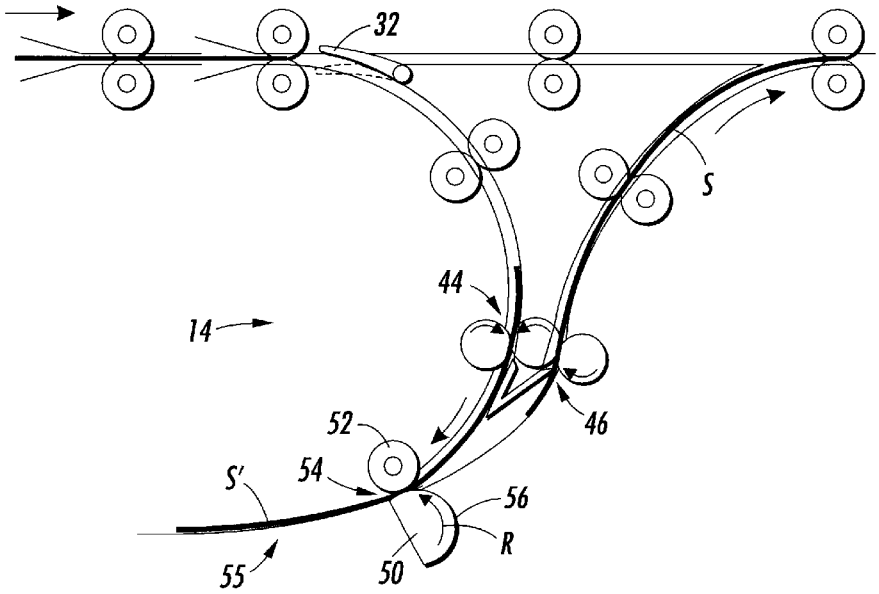
FIG. 9

SHEET INVERTING APPARATUS AND METHOD

FIELD OF THE INVENTION

The present invention relates to an improved sheet inverting method and apparatus for inverting sheets traveling through a machine, for example, a printing or photocopying machine.

BACKGROUND OF THE INVENTION

As xerographic and other copiers and printers increase in speed and become more automatic, it is increasingly important to provide higher speed yet more economical, reliable and more automatic handling of both the print sheets being printed by the machine and the original document sheets being copied. It is also desired to accommodate sheets which may vary widely in size, weight, thickness, material, condition, humidity, age, etc. These variations change the beam strength or flexural resistance and other characteristics of the sheets. Yet, the desire for automatic and high speed handling of such sheets without jams, misfeeds, uneven feeding times, damaged sheets, smeared print or other interruptions increases the need for reliability of all sheet handling components. A sheet inverter is one such sheet-handling component with particular reliability and speed limitation problems.

Although a sheet inverter is referred to in the copier and printer art as an "inverter", its function is not necessarily to turn the sheet over (i.e., exchange one face for the other). Its function may be to effectively reverse the sheet orientation in its direction of motion. That is, to reverse the leading edge and trailing edge orientation of the sheet. Typically in inverter devices, the sheet is driven or fed by feed rollers, conveyors or other suitable sheet driving mechanisms into a sheet-reversing chute. By then reversing the motion of the sheet within the chute and feeding it back out from the chute, the desired reversal of the leading and trailing edges of the sheet in the sheet path is achieved.

Depending on the location and orientation of the inverter in a particular sheet path, the reversal of the leading and trailing edges of the sheet may or may not also accomplish an inversion (turning over) of the sheet. In some applications, for example, where the "inverter" is located at the corner of a 90° to 180° bend in the copy sheet path, the inverter may be used to prevent inversion of a sheet and thereby maintain the same face of the sheet face-up before and after this bend in the sheet path. On the other hand, if the entering and departing path of the sheet, to and from the inverter, is in substantially the same plane, the inverter will invert the sheet. Thus, inverters have numerous known applications in the handling of either original document sheets or print sheets (collectively referred to herein as "print sheets" or simply "sheets") to selectively maintain and/or change the sheet orientation.

Inverters are particularly useful in various systems for pre or post collation copying or printing, for inverting the original documents, or for maintaining proper collation of the print sheets. The facial orientation of the sheet determines whether it will be stacked in forward or reversed serial order. Generally, the inverter is associated with a by-pass sheet path and gate so that a sheet may selectively by-pass the inverter, in order to provide a choice of inversion or non-inversion. Inverters are also useful in inverting the sheet to print on and/or copy from both sides of the sheet for duplex copying and printing.

In one type of known reversing chute inverter, the sheet is fed into and then wholly or partially released from a positive feeding grip roller pair or input nip into the reversing chute. The sheet is then reacquired by a different feeding grip roller pair or exit nip and is driven in the reverse direction to exit the reversing chute. U.S. Pat. Nos. 3,944,212 and 4,078,789 are examples of tri-roll type reversing chute inverters. A tri-roll reversing chute inverter includes a set of three rollers (the tri-roll) that defines the input and exit nips of the inverter. A reversing pinch roll pair or reversing nip is located downstream of the tri-roll in the reversing chute. The reversing nip reverses the sheet's direction of travel and feeds the sheet into the output nip.

In U.S. Pat. Nos. 3,944,212 and 4,078,789 cited above, the reversing nip is rotated in the reverse direction only and is maintained open as the copy sheet is fed into the reversing nip by the input nip. A sensor just downstream of the input nip senses when the trailing edge of the sheet has exited the input nip. When it is sensed that the sheet has exited the input nip, the reversing nip is activated to engage the sheet and drive the sheet in the reverse direction into the exit nip. For a brief period, between the time the sheet exits the input nip and is re-acquired by the reversing nip, the sheet is not positively gripped by any feed nips and is traveling freely under it's own momentum.

The inverters disclosed in U.S. Pat. Nos. 3,944,212 and 4,078,789 open a gap in the reversing nip by forming a flat on the drive roller of the nip and stopping the drive roller with the flat facing the idler roller. The sheet may then enter the gap between the drive roller and the idler roller unimpeded. Once the trailing edge of the sheet has cleared the input nip, then the drive roller is rotated one revolution in the reverse direction. As the drive roller is rotated one revolution, the cylindrical portion of the drive roller contacts the idler roller, thereby pinching the sheet therebetween and driving the sheet in the reverse direction into the exit nip.

Any loss of positive gripping of the sheet by the feed mechanism during inversion, even if only very briefly, increases the reliability problems of such inverters. As the speed of the printing or copying machine is increased, the time frame after the sheet is released from the input nip within which the reversing nip roller pair must re-acquire the sheet in order to reverse the sheet's direction becomes very short. The speed at which the reversing nip roller pair can engage the copy sheet is limited by the mass of the rollers and other factors that will be apparent to those of skill in the art. As a result, there is a maximum sheet speed beyond which the reversing nip rollers will not be able to close quickly enough to re-acquire the sheet. In which case, the sheet will clear the reversing nip and become jammed in the reversing chute.

As the overall machine speed increases, the speed at which the sheet enters and exits the reversing chute also increases. In U.S. Pat. Nos. 3,944,212 and 4,078,789 cited above, the reversing nip rotates in the reverse direction only, and must rotate more quickly as sheet speed increases in order to re-acquire the sheet and feed it into the exit nip within the available time frame. Thus, as the overall machine speed increases, the speed differential between the reversing nip and the copy sheets also increases. When the reversing nip engages the copy sheet at higher and higher speed differentials, the likelihood that the reversing nip will scuff, buckle, tear and/or otherwise damage the sheet increases.

Some devices have attempted to solve the above mentioned problem by providing a reversing nip that applies a constant reverse drive force upon the sheet that is less than the forward drive force applied to the sheet by the input nip. The drive roll in the reversing nip of such an inverter is always in contact with the idler roll and is always rotating in the reverse direction. Once the trailing edge of the sheet exits the input nip, the sheet is virtually immediately reversed by the reversing nip and driven into the exit nip. U.S. Pat. Nos. 4,359,217 and 4,346,880 are examples of such constant return force reversing nip inverters. The constant return force and friction applied to the sheet by the reversing nip drive roller in his type of arrangement, however, may scuff, buckle, tear, smear or otherwise damage the sheet, particularly as speeds increase.

Other prior art reversing chute inverters, such as disclosed in U.S. Pat. No. 4,487,506, the disclosure of which is hereby incorporated herein as of reference, provide a reversing nip roller pair in the reversing chute. Referring now to FIG. 1, the sheet enters the inverter 1 through the input nip 3 and is positively driven by the input nip into the reversing nip 5. The reversing nip, which is rotating in the forward direction at the same speed as the input nip, acquires the leading edge of the sheet (not shown) before the trailing edge of the sheet exits the input nip. Since the reversing nip 5 takes up the drive of the sheet at the same speed as the input nip, the reversing nip will not scuff, tear, mark, smear or otherwise damage the sheet. When the trailing edge of the sheet exits the input nip the reversing nip is decelerated, halted and accelerated in the reverse direction and drives the sheet in the reverse direction into the exit nip 7. The reversing nip is accelerated to the same speed as the exit nip before the leading edge of the sheet enters the exit nip. The exit nip therefore acquires the leading edge of the sheet before the trailing edge of the sheet exits the reversing nip without scuffing, buckling, tearing, smearing or otherwise damaging the sheet. This type of inverter maintains constant drive control of the sheet and relatively gently decelerates and reverses direction of the sheet.

The reversing nip described in the preceding paragraph substantially overcomes many of the sheet control and damage problems of previous reversing chute inverters. However, this type of forwarding reversing nip has a built in speed limitation. The trailing edge of a first or preceding sheet must exit the reversing nip 5 and the reversing nip must decelerate, reverse direction and accelerate to the input nip speed in the forward direction before the leading edge of a second or following sheet reaches the reversing nip. If the reversing nip 5 has not reached the same speed as the speed of the input nip 3 before the leading edge of a following sheet reaches the reversing nip, then the following sheet is likely to be scuffed, torn, buckled, smeared and/or jammed in the reversing chute.

SUMMARY OF THE INVENTION

One form of the present invention provides a method of inverting sheets traveling through a machine with an inverter having a reversing chute and a reversing nip in the reversing chute, the method comprising the steps of: a) receiving an incoming sheet into the reversing chute; b) reversing the direction of travel of the incoming sheet with the reversing nip, and driving the previously incoming sheet, which is now an outgoing sheet, out of the reversing chute; c) opening a gap in the reversing nip, while the outgoing sheet still extends through the gap in the reversing nip; d) receiving a subsequent incoming sheet into the reversing chute and through the gap in the reversing nip, while the outgoing sheet still extends through the gap; e) closing the gap in the reversing nip after the outgoing sheet has exited the reversing nip, thereby acquiring drive of the subsequent incoming sheet; and f) reversing the direction of travel of the subsequent incoming sheet with the reversing nip, and driving the subsequent incoming, which is now an outgoing sheet, out of the reversing chute.

Another form of the present invention provides a sheet inverter for inverting sheets traveling along a sheet path in a machine, the inverter comprising: a sheet reversing chute for receiving an incoming sheet; a reversing drive nip, formed of a drive roller abutting an idler roller, located in the reversing chute, such that the reversing nip reverses the incoming sheet's direction of travel and drives the previously incoming and now outgoing sheet in the reverse direction out of the reversing chute; and a reversing nip gap device for opening a gap between the drive roller and idler roller before the outgoing sheet has exited the reversing nip, such that a subsequent incoming sheet may pass through the gap in the reversing nip while the outgoing sheet still extends through the gap; wherein the gap device closes the gap after the outgoing sheet has exited the reversing nip, such that the reversing nip reverses the subsequent incoming sheet's direction of travel and drives the previously incoming and now outgoing sheet in a reverse direction out of the reversing chute.

BRIEF DESCRIPTION OF THE DRAWINGS

One form of the present invention will now be described, by way of example, with reference to the appended drawings, of which:

FIGS. 4 though 9 are serial views illustrating the passage of two consecutive sheets through the inverter of FIG. 3.

DETAILED DESCRIPTION OF AN EMBODIMENT OF THE INVENTION

Figure 1:
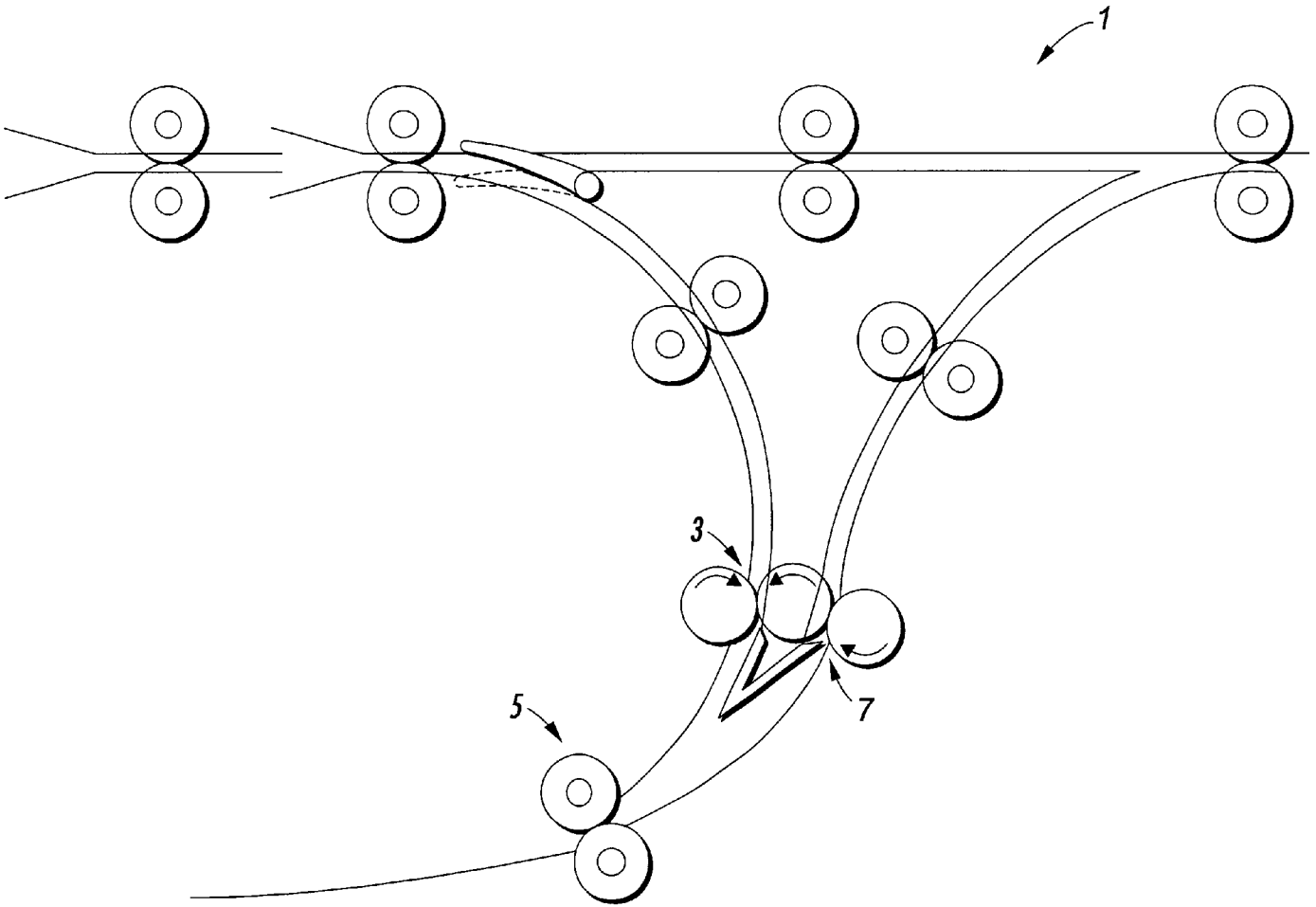
FIG. 1 PRIOR ART
FIG. 1 is a diagrammatic side view of a prior art tri-roll inverter apparatus.
Figure 2:
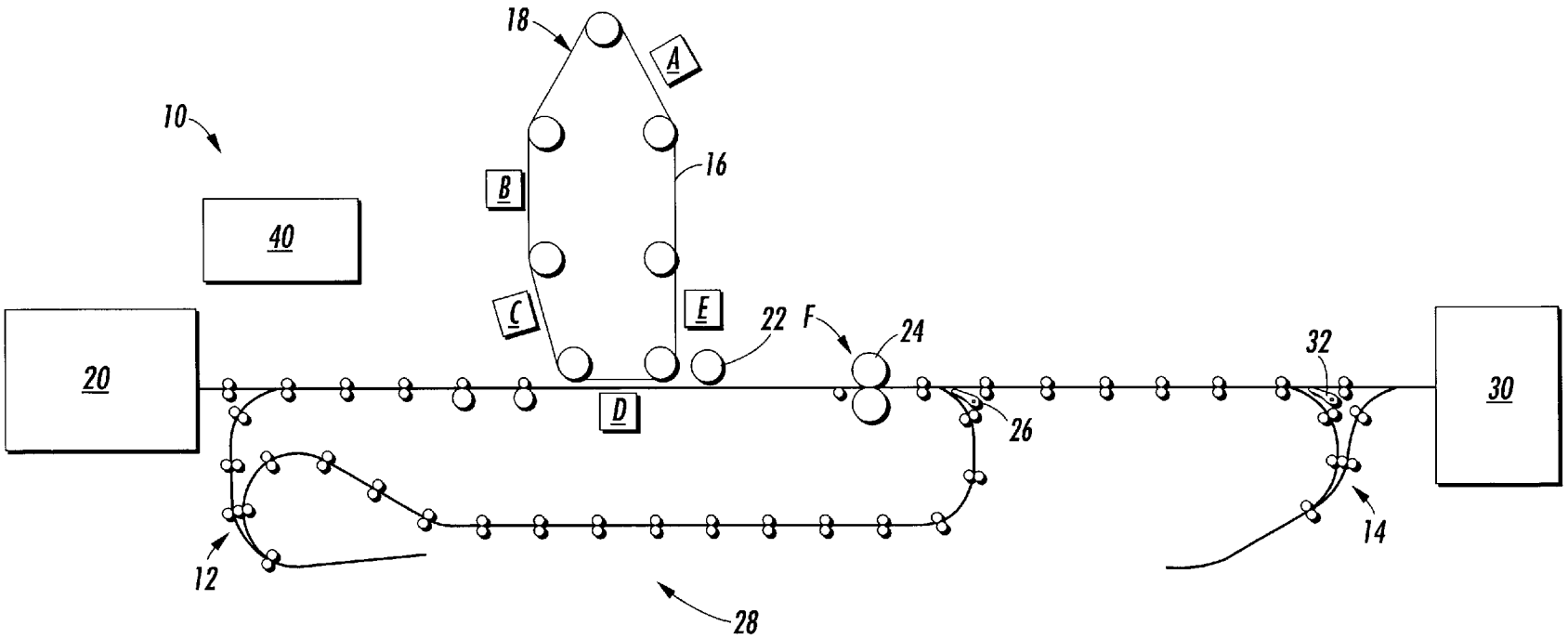
FIG. 2 is a diagrammatic side view of an exemplary xerographic printing system employing tri-roll inverters.

Referring now to FIG. 2, there is shown a schematic illustration of an exemplary xerographic printing machine 10 that employs inverters 12, 14 according to one form of the present invention. The illustrated printing machine includes a conventional photoconductive layer or light sensitive surface 16 on a conductive backing in the form of a belt 18. The belt is mounted on a plurality of rollers journaled in a frame (not shown), in order to rotate the belt and cause the photoconductive surface 16 to pass sequentially through a plurality of xerographic process stations A through E. It should be understood that a drum photoreceptor and/or flash exposure could be employed in place of the photoreceptor belt and exposure means illustrated in FIG. 2.

For purposes of the present disclosure, the several generally conventional xerographic processing stations in the path of movement of the photoconductive surface 16 may be as follows. A charging station A, where the photoconductive surface of the xerographic belt 18 is uniformly charged. An exposure station B, where a light or radiation pattern of a document to be printed is projected onto the photoconductive surface to expose and discharge select areas of the photoconductive surface to form a latent image thereon. A developing station C, where xerographic developer is electrostatically applied to the photoconductive surface of the drum to generate a toner image on the photoconductive surface. A transfer station D, where the toner image is electrostatically transferred from the photoconductive surface to a print sheet. Finally, a cleaning station E, where the photoconductive surface is brushed or otherwise cleared of residual toner particles remaining thereon after image transfer. In order to generate multi-color prints, there may be a group of process stations A through C for each of a plurality of colors. For example, there may be a group of stations A through C for each of yellow, cyan, magenta and black Print sheets supplied from a sheet feeding tray or sheet feeding module 20, are fed by a series of sheet feeding rollers and guide rails to the transfer station D. At the transfer station, the developed toner image is transferred from the photoconductive belt 18 to the sheet. The sheet is then stripped from the photoreceptor belt by a sheet stripper 22 and transported to a fusing station F, where a fuser 24 fuses the toner image onto the print sheet in a known manner. The print sheet, which now has an image fused to a first face thereof, is then transported by a plurality of rollers to a first gate 26. The first gate either diverts the sheet into a duplexing module 28 for two-sided or duplex copying, or allows the sheet to continue on toward an output tray or stacking module 30 for one-sided or simplex copying. On its way to the stacking module, the sheet passes a second gate 32 that either diverts the sheet into an output inverter 14 for inversion prior to entering the stacking module, or allows the sheet to pass directly into the stacking module without inversion.

A sheet that is diverted by the first gate 26 into the duplexing module 28 is inverted by a duplex inverter 12. Following inversion, the sheet is returned to the transfer station D to receive a second toner image on the second face thereof from the photoconductive belt. The second toner image is fused to the sheet at the fusing station F and the first gate allows the sheet to be conveyed toward the stacking module 30. The sheet may pass directly into the stacking module 30 or be diverted by the second gate 32 into the output inverter 14 for inversion prior to entering the stacking module.

A programmable machine controller 40, such as the controller disclosed in U.S. Pat. No. 3,940,210, the disclosure of which is incorporated herein by reference, is used to control the operation of xerographic machine 10 in either the simplex or duplex modes. Alternatively, conventional counters and circuitry as disclosed in U.S. Pat. No. 3,588,472, the disclosure of which is incorporated herein by reference, could be used to carry out the invention as disclosed herein.

Figure 3:
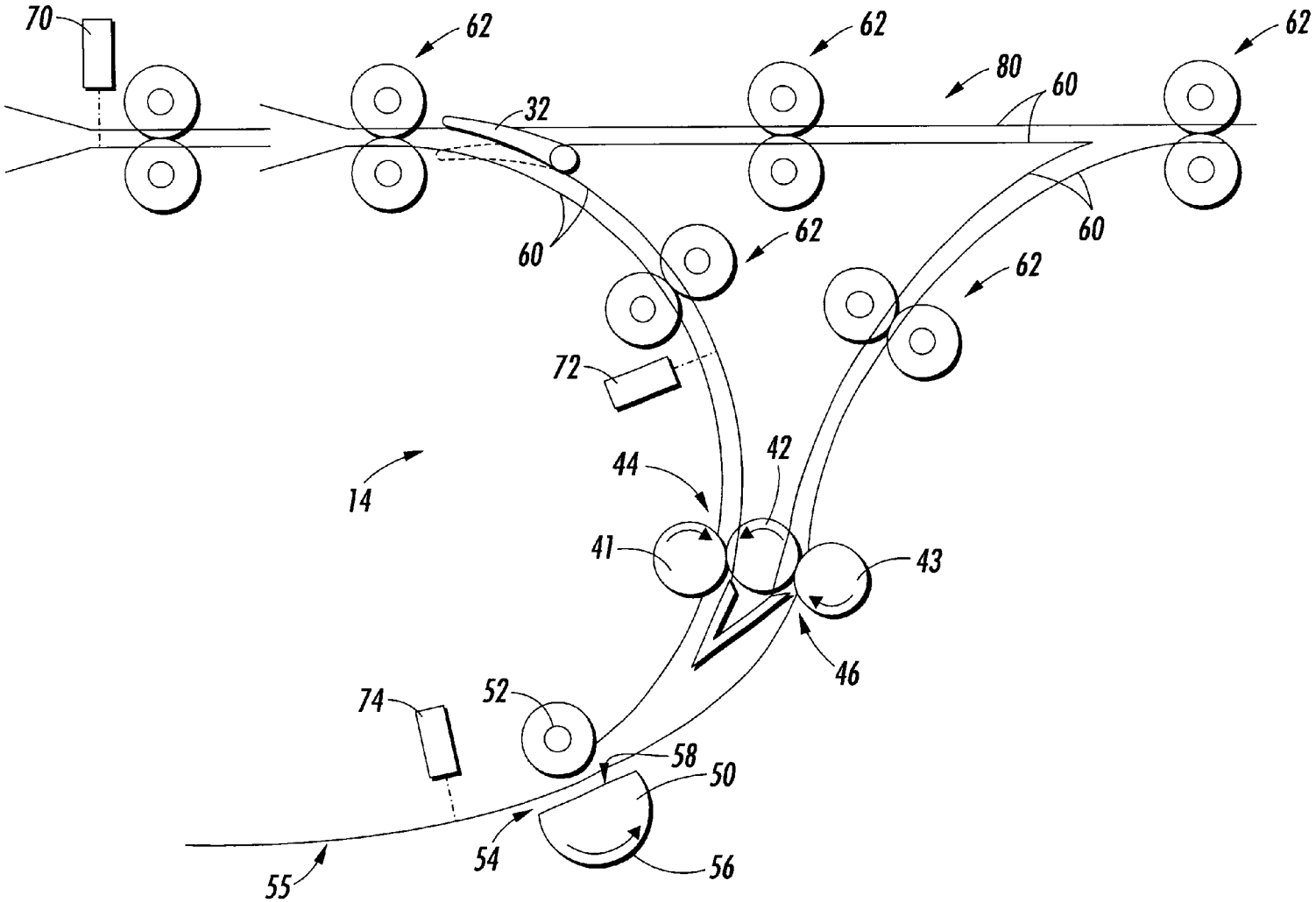
FIG. 3 is an enlarged diagrammatic side view of a tri-roll inverter employing a segmented reversing nip roller pair according to one form of the present invention.

An output inverter 14 according to one form of the present invention is schematically illustrated in side view in FIG. 3. The illustrated inverter comprises an improved tri-roll reversing chute type inverter. Three rollers 41, 42, 43 form the tri-roll. Rollers 41 and 42 of the tri-roll meet to form an input nip 44 and rollers 42 and 43 of the tri-roll meet to form an output nip 46. A reversible pair of rollers, namely, a segmented drive roller 50 and an idler roller 52, forms a reversing nip 54. The reversing nip is located in a reversing chute 55. The drive roller 50 of the reversing nip is segmented, meaning the drive roller has a semi-cylindrical peripheral drive surface 56 with a cutout or flat spot 58 on one side. The reversing nip's drive roller is driven by a variable speed, reversible drive motor (not shown) that is connected to the drive roller 50 through a suitable coupling (not shown). With this construction, the drive roller 50 can be driven in a clockwise or counterclockwise direction at variable speed, depending on the control signal received from the controller, as will be described in further detail hereinafter. A plurality of guide rails 60 guide the print sheets along the paper path between a plurality drive nips 62.

The passage of two consecutive sheets, e.g. a leading sheet S and a following sheet S', through the inverter of FIG. 3 is serially illustrated by FIGS. 4 through 9. When inversion of a sheet S traveling from the fuser to the stacking module is not desired, the second gate 32 is placed in a non-inverting position illustrated by dashed lines in FIGS. 3 through 9. When the second gate is in the non-inverting position the sheet is allowed to pass directly to the stacking module 30 (see FIG. 2) via an inverter by-pass path 80.

When it is desired to invert the print sheet before it enters the stacking module 30, the second gate 32 is moved into an inverting position shown in solid lines in FIGS. 3 through 9. When in the inverting position, the second gate intercepts the print sheet S traveling from the fuser 24 toward the stacking module and diverts the sheet into the output inverter 14 as illustrated in FIG. 4. Guide rails direct the leading edge of the sheet into the input nip 44. The input nip acquires the sheet S and drives the sheet into the reversing chute 55.

Prior to entry of the sheet S into the reversing chute 55, the drive roller 50 of the reversing nip 54 is positioned and stopped in a gap position, in which the flat 58 faces the idler roller 52. When the drive roller is in the gap position, a gap 59 is formed in the reversing nip between the drive roller and the idler roller. The drive roller is maintained in the gap position to await the arrival of an incoming sheet. The leading edge of an incoming sheet S may pass unimpeded into and through the gap 59 in the reversing nip, as illustrated in FIG. 4. Before the trailing edge of the sheet S exits the drive nip 44, the drive roller 50 of the reversing nip 54 is accelerated in a forward direction, as indicated by arrow R, to a sheet drive speed that is equal to the sheet drive speed of the input nip 44. The semi-cylindrical drive portion 56 of the drive roller engages the idler roller 52 at the same speed as the input nip, thereby closing the gap and acquiring drive of the sheet S as shown in FIG. 5. The reversing nip is thereby closed and acquires drive of the sheet S before the trailing edge of the sheet exits the input nip 44.

Once the tailing edge of the sheet S has exited the input nip 44, the reversing nip 54 is decelerated and stopped, with the trailing edge of the sheet clear of a guide wedge 82 as shown in FIG. 6. In the illustrated embodiment, the reversing chute 55 is curved away from the output nip 46, i.e. to the left in FIGS. 4 through 9. With this construction, the beam strength of the sheet S causes the sheet to straighten in the reversing chute, as indicated by arrow Y in FIG. 6. When the sheet straightens, the trailing edge of the sheet moves from the input side to the output side of the guide wedge 82. The reversing nip 54 is then accelerated in the reverse direction, as shown by arrow R' in FIG. 7, and drives the previously trailing and now leading edge of the sheet S into the output nip 46. The reversing nip is accelerated to a sheet drive speed that is equal to the sheet drive speed of the output nip before the now leading edge of the sheet reaches the output nip.

The spacing between the reversing nip 54 and the output nip 46 is set at approximately the same distance as the spacing between the input nip 44 and the reversing nip 54. With this construction, when driving the sheet S in the reverse direction, the drive roller 50 will rotate to the gap position shortly after the output nip 46 has acquired positive drive of the sheet S. The drive roller 50 is then halted in the gap position, such that the gap 59 is again formed in the reversing nip 54. The drive roller is maintained in the gap position to await the arrival of a subsequent or following sheet S'. The gap 59 allows the leading edge of a following sheet S' to enter the reversing nip, while the now trailing edge of the leading sheet S is still extending through the gap as shown in FIG. 8. The leading sheet S and the following sheet S' thus overlap in the gap 59 in the reversing nip and in the reversing chute 55. The larger the sheets S and S' are from leading to trailing edge, the larger the degree of overlap will be in the reversing chute.

Once the now trailing edge of the leading sheet S clears the reversing nip 54, the reversing nip is accelerated in the forward direction R to the speed of the input nip 44. The reversing nip closes and acquires the following sheet S', as illustrated in FIG. 9, at the same sheet drive speed as the input nip. The following sheet S' now becomes a leading sheet in relation to the next following sheet (not shown) and the cycle illustrated in FIGS. 4 through 9 is repeated with each subsequent following sheet.

As described above, the sheet S is only driven in the forward direction by the reversing nip 54 from a point just prior to release of the sheet by the input nip 44 (as shown in FIG. 5) to the point where the trailing edge of the sheet clears the guide wedge 82 (as shown in FIG. 6). The length of the arc formed by semi-cylindrical drive portion 56 of the reversing nip drive roller 50 must therefore be at least as long as the distance the sheet travels between these two points. The length of the arc on the drive roller is determined by appropriately selecting the diameter of the drive roller and the depth of the flat 58. For example, if the distance between the input nip 44 and the desired flip point of the trailing edge of the sheet S (see sheet S in FIG. 6) were 3 inches, then the semi-cylindrical drive portion 56 could be formed with an arc having a length of about 4 inches. A 4 inch arc 56 would incorporate an optional safety factor of 1 inch. To achieve this, a 1.75 inch diameter roll having a total circumference of 5.5 inches could be utilized. Removal of about 25% of the roll would result in a flat 0.44 inches deep and leave the required arc.

Sensors 70, 72, and 74 (see FIG. 3) sense the leading and/or the trailing edges of the sheets as the sheets travel through the inverter and forward corresponding signals to the controller. The sheet sensors 70, 72, and 74 are strategically placed along the sheet path in the output inverter 14, in order to facilitate control of the drive rollers in the inverter by the controller. The first sensor 70 is located a predetermined distance upstream of the inverter. The first sensor detects the leading edge of a sheet entering the inverter 14 and delivers a corresponding signal to the controller. After a predetermined delay period has elapsed following detection of the leading edge of the sheet by the first sensor, the controller initiates an acceleration of the sheet within the inverter from an image process speed to an inversion speed.

The second sensor 72 is located a predetermined distance upstream of the input nip 44. The second sensor detects the trailing edge of a sheet S traveling through the inverter 14 and sends a corresponding signal to the controller.

After a first predetermined delay period has elapsed following detection of the trailing edge of an incoming sheet S by the second sensor 72, the controller initiates an acceleration of the reversing nip drive roller 50 in the forward direction R, as illustrated in FIG. 4. The acceleration of the drive roller is timed and controlled such that the reversing nip 54 closes and acquires the incoming sheet S at the same speed as the sheet is being delivered by the input nip 44, as shown in FIG. 5.

The controller then initiates a deceleration of the reversing nip 54 after a second predetermined delay period following detection of the trailing edge of the sheet S by the second sensor 72. The second delay period is set to initiate deceleration after the trailing edge of the sheet has exited the input nip 44. The deceleration is controlled such that the sheet S is brought to rest with its trailing edge clear of the guide wedge 82, as depicted in FIG. 6.

Next, after a third delay period following detection of the sheet's trailing edge by the second sensor, the controller initiates an acceleration of the drive roller 50 in the reverse direction R' and drives the sheet into the output nip 46, as depicted in FIG. 7. The third delay period is set to provide a dwell time after the sheet has been stopped clear of the guide wedge, in order to enable the sheet to straighten as depicted by arrow Y in FIG. 6. The acceleration of the drive roller in the reverse direction R' is controlled such that the reversing nip 54 delivers the sheet to the output nip at the same speed as the output nip drives the sheet. Finally, the controller brings the drive roller 50 to rest in the gap position, with the flat 58 facing the idler roller 52, to await the arrival of a subsequent incoming sheet S', as shown in FIG. 8.

The third sensor 74 is located in the reversing chute 55, in order to detect a sheet that has become jammed or otherwise stuck in the reversing chute and send a corresponding signal to the controller. The controller then executes a typical jam shutdown and alarm sequence, thereby preventing further sheets from becoming jammed and alerting the operator of the jam.

The duration of the various delay periods described above will depend upon numerous factors. Some of these factors are, how far the first sensor is from the inverter, how far the second sensor is from the input nip and the reversing nip, how far the reversing nip is from the input nip and the output nip, the length of the drive surface 56 on the drive nip, and the magnitude of the processing and inverting speeds, as will be well understood by one of skill in the art.

A specific arrangement of sensors and the interaction of the sensors with the controller has been described above. One of skill in the art will appreciate, however, that other arrangements of sensors may be employed to achieve the desired result with a segmented reversing nip inverter according to the present invention. The disclosed arrangement and use of sensors is an exemplary arrangement. The present invention is not intended to be limited to the specific arrangement and use of sensors that is illustrated and described, but to include all such alternatives that are compatible with the claimed invention.

The invention has been described by way of example with reference to the output inverter 14 as illustrated in FIGS. 3 through 9. The duplex inverter 12 (FIG. 2) is similar to the output inverter, except that duplex inverter does not include an inverter bypass path 80 (FIG. 3) or an associated gate. Since only sheets requiring inversion for duplex printing or copying are directed into the duplexing module 28 by the first gate 26 (FIG. 2), all the sheets traveling through the duplexing module require inversion and must pass through the duplex inverter. Therefore, the duplex inverter does not require an inverter bypass path and gate. Furthermore, the first sensor 70 may be located in the duplexing path upstream of the duplex inverter 12, such that the sheets are accelerated to inversion speed prior to arriving at the duplex inverter. Such an arrangement enables the inverter to operate at a constant speed, i.e. inversion speed, and simplifies the control of the inverter.

As described above, the formation of a gap in the reversing nip enables an incoming following sheet to overlap an outgoing leading sheet in the reversing nip in the reversing chute. The present invention thus enables a following sheet to follow more closely behind a leading sheet than in prior art inverters. In the prior art inverter of FIG. 2, a leading sheet must clear the forwarding reversing nip. The forwarding reversing nip must then be decelerated from the speed of the output nip in the reverse direction, stopped and accelerated in the forward direction to the speed of the input nip, all before the following sheet enters the reversing nip. Thus, the timing latitude and speed in sheets per minute are both increased by employing an inverter according to the present invention. As the length of the sheets from leading to trailing edge increases, the sheets overlap to a greater extent in the gap and in the reversing nip. Therefore, the gains in timing latitude and sheet speed increase compared to prior art inverters as sheet length increases.

One of skill in the art will appreciate that a segmented reversing roll according to the present invention may be used in reversing chute type inverters that do not utilize a tri-roll to form the input and output nips. For example, the input and output nips may be formed by respective input and output roller pairs, as illustrated in U.S. Pat. No. 3,416,791, the disclosure of which is hereby incorporated herein as of reference, rather than by a tri-roll arrangement.

It will also be appreciated that, rather than segmenting the drive roller, one of the idler roller and the drive roller of the reversing nip may be selectively moved away from and into engagement with the other, in order to selectively provide the gap and drive the sheets. Various mechanisms capable of moving one of the rollers away from and into engagement with the other are well known in the art, for example, see previously incorporated U.S. Pat. No. 3,416,791, and are therefore not described herein.

The reverse nip is disclosed herein as having a drive roller that is driven by a reversible variable speed motor. The reversal of direction of the drive roller may alternatively be achieved by employing a non-reversible motor drivingly connected to the drive roller via any suitable mechanism capable of reversing the drive applied to the drive roller by the motor. For example, a suitably geared transmission or two clutch drive mechanism may be employed. Previously mentioned U.S. Pat. No. 4,487,506, which is incorporated herein as of reference, discloses alternative mechanisms capable of reversing the rotation of a drive roller in a drive nip roller pair.

In addition to the method and apparatus disclosed above, other modifications and/or additions will be readily apparent to those skilled in the art upon reading this disclosure. All such modification and additions are intended to be encompassed within the invention disclosed and claimed herein.

What is claimed is:

1. A method of inverting sheets traveling through a machine with an inverter having a reversing chute, said method comprising the steps of:

a) providing a reversing nip comprised of a drive roller and an idler roller in said reversing chute;

b) forming said drive roller with a semi-cylindrical drive surface and a flat on one side thereof;

c) receiving an incoming sheet into said reversing chute;

d) reversing the direction of travel of the incoming sheet with said reversing nip, and driving the previously incoming sheet, which is now an outgoing sheet, out of said reversing chute;

e) opening a gap in said reversing nip by rotationally positioning said drive roller with said flat facing said idler roller, while the outgoing sheet still extends through said gap in said reversing nip;

f) receiving a subsequent incoming sheet into said reversing chute and through said gap in said reversing nip, while the outgoing sheet still extends through said gap;

g) closing said gap in said reversing nip by rotating said drive roller and engaging said drive surface with said idler roller, after the outgoing sheet has exited said reversing nip, thereby acquiring drive of the subsequent incoming sheet in the forward direction; and h) reversing the direction of travel of the subsequent incoming sheet with said reversing nip, and driving the subsequent incoming, which is now an outgoing sheet, out of said reversing chute.

2. The method according to claim 1, further comprising the steps of:

repeating steps e) through h) for each subsequent incoming sheet.

3. The method according to claim 2, further comprising the step of:

providing an input nip adjacent to said reversing chute; and wherein steps c) and f) of receiving an incoming sheet comprise the steps of:

receiving the incoming sheet in said input nip and driving the incoming sheet in a forward direction into said reversing chute;

acquiring drive of the incoming sheet with said reversing nip in the forward direction, while the incoming sheet is still being driven by said input nip.

4. The method according to claim 3, further comprising the step of accelerating said reversing nip in said forward direction to a sheet drive speed equal to a sheet drive speed of said input nip, before acquiring drive of the incoming sheet with said reversing nip.

5. The method according to claim 3, further comprising the step of:

providing an output nip adjacent to said reversing chute; and wherein the step of driving an outgoing sheet out of said reversing chute in steps d) and h) comprises the steps of:

driving the outgoing sheet in a reverse direction out of said reversing chute and into said output nip;

acquiring drive of the outgoing sheet with said output nip in said reverse direction, while the outgoing sheet is still being driven in said reverse direction by said reversing nip.

6. The method according to claim 5, further comprising the step of accelerating said reversing nip in said reverse direction to a sheet drive speed equal to a sheet drive speed of said output nip, before acquiring drive of the outgoing sheet with said output nip.

7. The method according to claim 6, further comprising the step of accelerating said reversing nip in said forward direction to a sheet drive speed equal to a sheet drive speed of said input nip, before acquiring drive of the incoming sheet with said reversing nip.

8. The method according to claim 7, further comprising the steps of:

opening said gap in said reversing nip before a first of said incoming sheets arrives at said reversing nip;

receiving said first incoming sheet into said reversing chute and through said gap in said reversing nip.

9. The method according to claim 7, further comprising the step of:

sensing a point in time when a trailing edge of a said incoming sheet is a predetermined distance upstream of said input nip and timing the acceleration and deceleration of said reversing nip from said point in time.

10. The method according to claim 5, wherein step e) of opening said gap occurs after the output nip has acquired drive of the outgoing sheet and before the subsequent incoming sheet arrives at said reversing nip.

11. The method according to claim 5, wherein said input and output nips are formed by a tri-roll having first, second and third abutting rollers, the first and second rollers abut to form the input nip, and the second and third rollers abut to form the output nip.

12. The method according to claim 1, wherein said machine is an electrostatographic reproduction machine.

13. A sheet inverter for inverting sheets traveling along a sheet path in a machine, said inverter comprising:

a sheet reversing chute for receiving an incoming sheet;

an idler roller in the reversing chute;

a drive roller abutting said idler roller to form a reversing drive nip located in the reversing chute, such that the reversing nip reverses the incoming sheet's direction of travel and drives the previously incoming and now outgoing sheet in the reverse direction out of the reversing chute;

a flat surface formed on a circumferential surface of the drive roller, with an arcuate portion of the circumferential surface of the drive roller forming a drive surface; and a controller that i) rotates the drive roller into a gap position in which the flat surface faces the idler roller to form the gap between the idler roller and the drive roller, and ii) rotates the drive roller such that the drive surface engages the idler roller to close the gap;

wherein the controller rotates the drive roller into the gap position opening the gap before the outgoing sheet has exited the reversing nip, such that a subsequent incoming sheet may pass through the gap in the reversing nip while the outgoing sheet still extends through the gap; and the controller rotates the drive roller closing the gap after the outgoing sheet has exited the reversing nip, such that the reversing nip acquires drive of the incoming sheet in the forward direction, reverses the subsequent incoming sheet's direction of travel and drives the previously incoming and now outgoing sheet in a reverse direction out of the reversing chute.

14. An inverter according to claim 13, further comprising:

an input drive nip that receives a sheet traveling along the sheet path and drives the sheet into the reversing chute; and wherein the controller accelerates the reversing nip in the forward direction to a speed that matches a speed of the input nip before closing the gap, whereby when the gap is closed the reversing nip drives the incoming sheet in the forward direction further into the reversing chute.

15. An inverter according to claim 14, wherein the controller closes the gap before the incoming sheet has exited the input nip.

16. An inverter according to claim 14, further comprising:

an output nip adjacent to the reversing chute, the output nip receives the outgoing sheet from the reversing nip and drives the sheet out of the inverter to continue along the sheet path; and wherein the controller accelerates the reversing nip in the reverse direction to a speed that matches a speed of the output nip, before the outgoing sheet is received by the output nip.

17. An inverter according to claim 16, wherein the controller opens the gap after the outgoing sheet is received in the output nip.

18. An inverter according to claim 17, wherein the controller closes the gap before the incoming sheet has exited the input nip.

19. An inverter according to claim 18, wherein the reversing nip gap device further comprises a reversible electric motor drivingly connected to the drive roller and operatively connected to the controller to receive control signals therefrom.

20. An inverter according to claim 19, further comprising a sensor located a predetermined distance upstream of the input nip, wherein the sensor detects a trailing edge of an incoming sheet and sends a corresponding signal to the controller; and the controller times the acceleration and deceleration of the electric motor from a time which it receives the signal from the sensor.

21. An inverter according to claim 15, wherein the machine is one of a printing or copying machine.

* * * * *